United States Patent [19]

Croll

[11] 4,126,501

[45] Nov. 21, 1978

[54] ARCHERY TARGET AND METHOD OF MAKING SAME

[76] Inventor: Lionel Croll, 10 W. 15th St., Barnegat Light, N.J. 08006

[21] Appl. No.: 778,005

[22] Filed: Mar. 16, 1977

[51] Int. Cl.[2] ..... B31F 1/12

[52] U.S. Cl. ..... 156/183; 93/1 WZ; 156/184; 273/102 B

[58] Field of Search ..... 156/183, 184; 273/102 B; 93/1 WZ

[56] References Cited

U.S. PATENT DOCUMENTS

| | | | |
|---|---|---|---|
| 2,423,347 | 7/1974 | Saunders | 273/102 B |
| 3,329,431 | 7/1967 | Roesner | 273/102 B |
| 3,650,877 | 3/1972 | Johnson | 186/183 X |
| 3,900,778 | 8/1975 | Bruner | 273/102 B |

*Primary Examiner*—David A. Simmons
*Attorney, Agent, or Firm*—Robert K. Youtie

[57] ABSTRACT

An archery target and method of manufacture wherein a plastic film web is progressively gathered and wound into a cylindrical or disc-like formation with successive convolutions in engagement and combining to define interstitial openings or air pockets.

5 Claims, 6 Drawing Figures

10
11
12
13
14
15
20
21
22
23
24
26
27
28
30
31
32
33
35
36
37
38
39
40
41
45
46
47
50

ARCHERY TARGET AND METHOD OF MAKING SAME

BACKGROUND OF THE INVENTION

While the method and product of the present invention have been primarily developed and employed in the field of archery targets, and will be illustrated and described hereinafter with particular reference thereto, it is appreciated that the invention is capable of many varied applications, say as targets for other kinds of projectiles, and all of such applications are intended to be comprehended herein.

As is well known to those versed in the field of archery, targets are now generally constructed of excelsior, cardboard and other materials, and such targets are relatively expensive and short lived, especially in tournament use, and the like, where the target center is frequently impaled. While certain improvements have been proposed, such as the use of removable and replaceable central target portions or "bull's-eyes", these proposals have not been entirely satisfactory, primarily adding to costs both initially and in continuing maintenance.

SUMMARY OF THE INVENTION

It is an important object of the present invention to provide an archery target and method of manufacture which overcomes the above mentioned difficulties, affording greatly enhanced useful life, even under accurate conditions of tournament use, so as to require considerably reduced maintenance and replacement, and to effect substantial savings in overall cost while affording a uniformly higher quality of target to the users throughout its extended life.

It is a more particular object of the present invention to provide a target and method of manufacture wherein plastic sheeting or film is gathered or bunched to define internal air pockets or interstitial openings, which structure serves by the thermoplastic nature of the sheeting to quickly dissipate and effectively retard projectile movement upon impaling or penetration, while the intersticies serve to alleviate heat build-up, and assure a sufficient softness or cushioning by the target to assure impaling thereby and holding therein even of relatively lightweight and slow moving projectiles.

It is still another object of the present invention to provide a unique target construction and method of manufacture which are extremely simple to effect substantial cost savings, durable and highly reliable throughout a long useful life, and highly effective under widely varying conditions of use so as to be versatile for use throughout the range from beginner to expert.

Other objects of the present invention will become apparent upon reading the following specification and referring to the accompanying drawings, which form a material part of this disclosure.

The invention accordingly consists in the features of construction, combinations and arrangements of parts and method steps, which will be exemplified in the following description, and of which the scope will be indicated by the appended claims.

DESCRIPTION OF THE PREFERRED EMBODIMENTS

Figures 1, 2, 3:
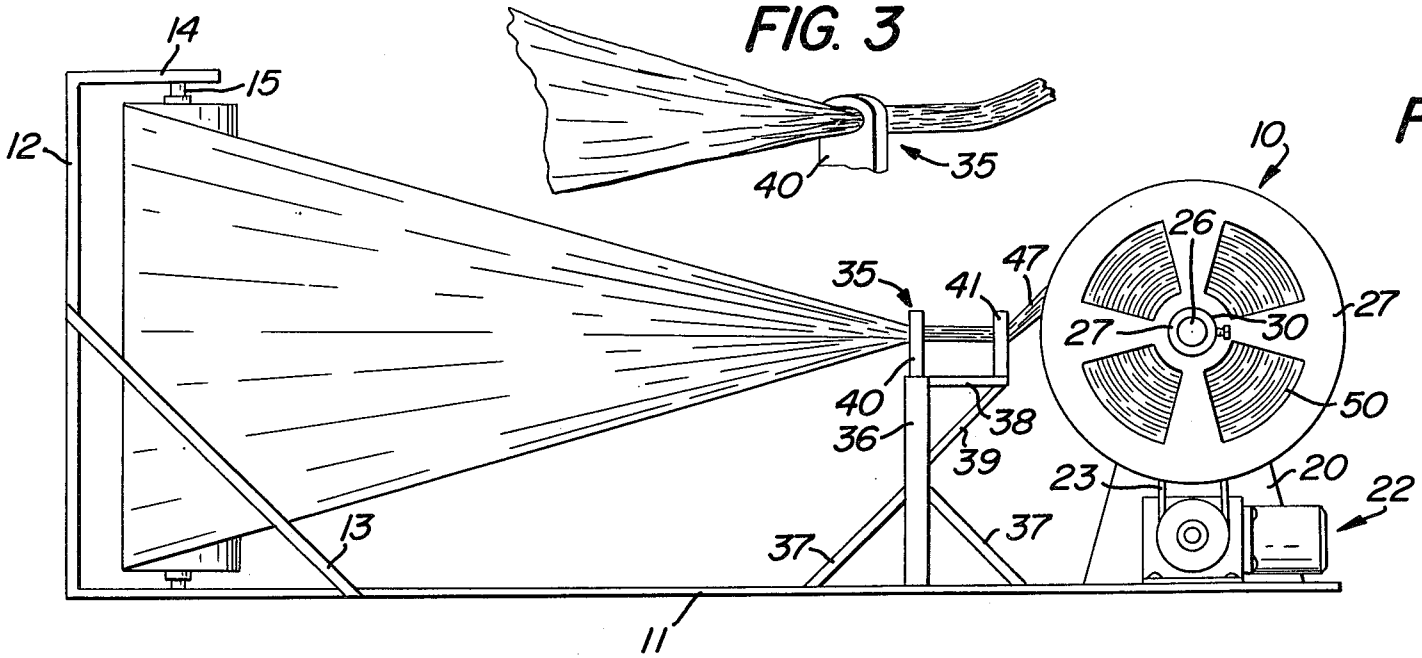
FIG. 1 is a side elevational view showing apparatus manufacturing a target construction in accordance with the method of the instant invention.
FIG. 2 is a top plan view of the apparatus of FIG. 1.
FIG. 3 is a partial perspective view illustrating an intermediate stage in the feeding, gathering and winding of the instant method.

Referring now more particularly to the drawings, and specifically to FIGS. 1 and 2 thereof, there is illustrated therein apparatus generally designated 10, and including a generally horizontal bottom plate or base 11 of elongate configuration. Upstanding from one end of the base 11 is a generally vertical post or strut 12, which may be rigidified by a pair of diagonal braces 13 declining from the strut 12 to the base 11. From the upper end of the upstanding member or strut 12, extending inwardly in spaced relation over the end portion of base 11, is a bracket 14. A generally vertically disposed spindle or rotary shaft 15 extends between the bracket 11 and nether region of base 12, being mounted in the bracket and base for rotation about its generally vertical axis.

Remote from the upstanding member 11 and rotary spindle 15, and upstanding from the base 11 is a pedestal 20 in the nature of shaft bearing or pillow block and rotatably supporting an elevated, generally horizontal shaft 21, extending generally transverse or normal to the longitudinal dimension of base 11. The rotary shaft 21 is located at a height or elevation approximating the mid-region of upright 12.

Suitable motive or drive means 22 may be mounted on the base 11, say beneath the shaft 21 and coupled in driving relation with respect to the shaft by suitable power transmission means, such as a belt 23 and a pulley or sheave 24 keyed to the shaft 21.

The journal pedestal 20 is offset laterally of the elongate base 11 from the axis of spindle or roll 15, and a shaft overhang or stub 26 projects from shaft 21 outboard of the pedestal 20. A wind-up reel or collection wheel 27 is mounted on the stub shaft 26, being coaxially rotatable therewith and detachably secured thereto, as by a collar 27 and radial fastener 28. The wind-up reel 27 may include a central hub or mandrel 30 circumposed about the stub shaft 26 and a pair of generally circular, spaced side members or discs 31 and 32 carried by the hub for rotation therewith. The spacing between discs 31 and 32 may be adjustable, if desired, for purposes appearing presently.

The take-up reel 27 may have its inter disc space 33 in approximate alignment with spindle 15, and a gathering or bunching means upstands from the base 11 between the spindle 15 and take-up reel 27. In practice, it may be desirable to locate the gathering stand 35 adjacent to the take-up reel.

The gathering stand 35 may include an upright or post 36 upstanding from the base 11 and suitably braced by diagonal struts 37. A horizontal bed or table 38 is carried by the upper end of strut 36, and may be suitably braced, as by a diagonal strut 39. The bed or table 38 extends generally longitudinally of the base 11, generally along a line between take-up reel 27 and spindle 15, and at an elevation approximating and slightly less than that of shaft 26. Upstanding from bed or table 38 are one or more constriction members or eyes, as at 40 and 41. That is, the constriction members or eyes 40 and 41 are fixed on and upstand from the table 38, having their through openings in general alignment with each other, longitudinally of the direction between spindle 15 and reel 27. The interior configuration of eyes 40 and 41 may be as desired in the configuration of eyes 40 and 41 may be as desired in the circumstances, say round, rectangular, or otherwise.

Carried by spindle or roll 15 is a roll or coil 45 of flexible plastic sheet or film 46. In practice, polyethylene plastic has been found satisfactory, particularly relatively thin gauge film commonly used in packaging, both for its thermoplastic qualities and impalability, all of which will be more fully described hereinafter. However, a wide variety of other plastics, in sheet or film form, may be employed.

The sheeting or film 46 may be of a width somewhat less than the vertical extent between base 11 and bracket 14, or a plurality of plastic film coils may be utilized in place of the single coil 45, if desired. From the coil 45, the film sheet 46 passes through successive gathering members or eyes 40 and 41, thereby being transversely or laterally gathered or bunched upon passage through the eyes, and the gathered condition, as at 47, wound about the take-up reel 27. Thus, the web 46 is fed from the coil or roll 45, suitable retarding means being applied to the let-off spindle 15, to maintain desired web tension. During feeding of the web 46 it is laterally or transversely gathered or bunched by the gathering means or eyes 40 and 41, and drawn therefrom in a spirally wound coil 50 on the reel 27. The reel 27 is powered from the motive means 22 to effect the coiling on the reel and uncoiling from the roll 45.

When a desired size or diameter of coil 50 is wound on reel 27, the coil may be removed, say by removal of the reel side member 32, and the cylindrical or disc like form of the coil is retained by suitable form retaining means.

Figure 4:
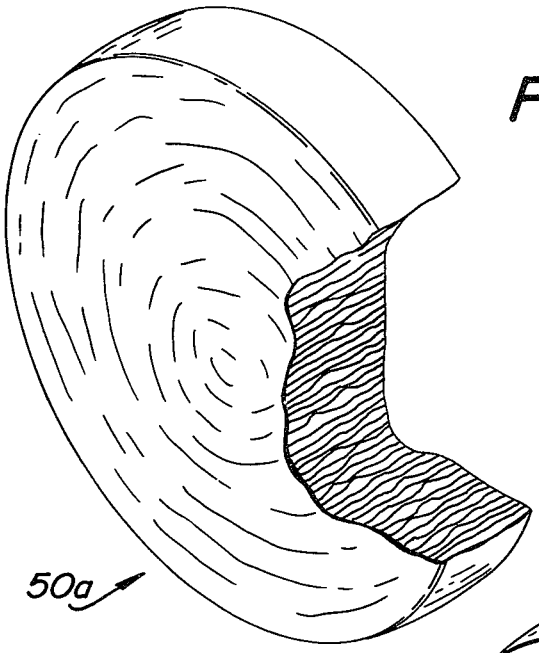
FIG. 4 is a perspective view showing a target construction of the present invention broken away to illustrate the interior.

In FIG. 4 the coil **50*a* has been removed from reel 27, and has been subjected to sufficient heat to cause partial heat sealing of the successive, engaging convolutions. Such heat sealing may be by timed heating in an oven, radio frequency or other. The relatively small central opening formed by the hub 30 in coil 50 may be allowed to close of itself upon removal of the coil, or may be closed by insertion of a filler or plug, if desired. In the condition of cylinder or disc 50*a*, the successive convolutions of gathered plastic sheeting or film 47 being wound in engagement with each other, it will be appreciated that there are formed therein a multitude of interstitial air pockets or cavities affording a yieldable resilience or cushion like character to the disc or body 50*a*. During the heat sealing, the body or cylinder 50*a* may be circumferentially wrapped or bound to a desired tightness to produce a desired firmness of the resultant body after adherence achieved by the partial heat sealing. Of course, heat sealing may be accomplished, or partially accomplished, while the coil or body remains on the reel 27**, before removal therefrom.

Figure 5:
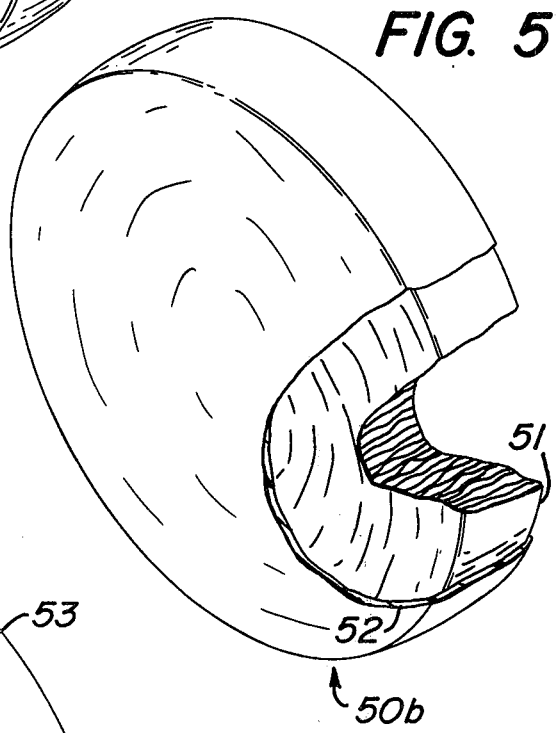
FIG. 5 is a perspective view showing a slightly modified embodiment also broken away to show internal construction.

Considering the embodiment shown in FIG. 5, a cylindrical form or disc **50*b* may include an inner body 51 as removed from the reel 27, and an outer covering or casing 52 encompassing the body 51 and effectively retaining the desired cylindrical or disc shape and form. The outer covering may be of plastic sheeting, as illustrated, and further, the combined disc shaped body 51 and outer covering 52 may be subjected to heat sealing to achieve adherence of adjacent plastic film portions. However, advantageous results are achieved without heat sealing of the embodiment of FIG. 5; and further, the encompassing cover 52 may not be closed, as illustrated, but may be of an open work net like character, or may be coated with contact adhesive for adherence to the exterior of inner body 51. For example, adhesive strips may be employed, say radially and circumferentially, over the exterior of body 51**, if desired.

Figure 6:
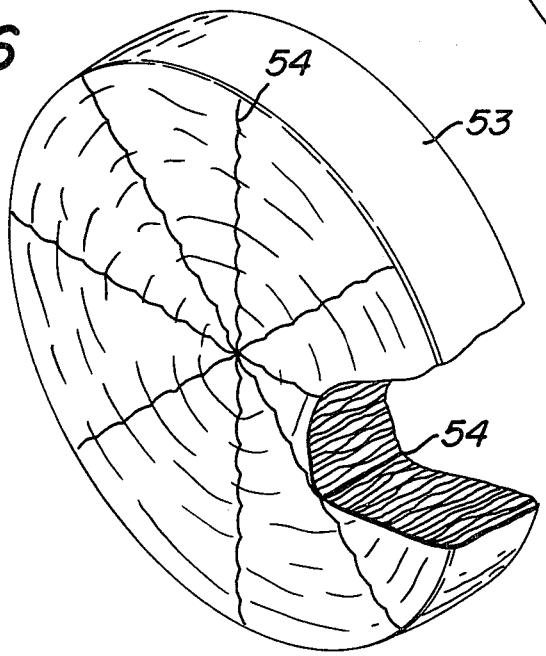
FIG. 6 is a perspective view showing still another embodiment broken away to illustrate the internal structure.

An additional embodiment is shown in FIG. 6, wherein a spirally wound body 53 may be removed from reel 27 as described hereinbefore, and the cylindrical or disc like configuration retained by other means, such as stitching 54 penetrating transversely of the body 53 and extending radially, or otherwise as desired.

From the foregoing, it is seen that the present invention provides unique improvements in an archery target and method of manufacture which greatly improves the target, its operation, useful life and cost, as well as simplifying and achieving substantial economies in manufacture and maintenance.

Although the present invention has been described in some detail by way of illustration and example for purposes of clarity of understanding, it is understood that certain changes and modifications may be made within the spirit of the invention.

What is claimed is:

1. The method of manufacturing a target comprising the steps: providing an elongate web of freely flexible plastic film, feeding said web endwise, passing said endwise fed web through a constriction to form longitudinally extending random gathers in the web, applying a retarding force to the feeding of web, winding said web about a mandrel against said retarding force into a cylinder having generally coplanar successively outwardly extending convolutions, and securing said cylinder in its cylindrical form.

2. The method of manufacturing a target according to claim 1, further characterized in winding said web into a cylindrical coil having successive convolutions in engagement with each other.

3. The method of manufacturing a target according to claim 1, further characterized in securing said cylinder by covering the same.

4. The method of manufacturing a target according to claim 1 further characterized in securing said cylinder by stitching the same.

5. The method of manufacturing a target according to claim 1, further characterized by securing said cylinder by heat sealing portions of said cylinder.

* * * * *